US010890353B2

(12) United States Patent
Mabon

(10) Patent No.: US 10,890,353 B2
(45) Date of Patent: Jan. 12, 2021

(54) CENTRIFUGAL PUMP FLOW MODIFIER

(71) Applicant: ASPEN PUMPS LIMITED, Hailsham Sussex (GB)

(72) Inventor: Jack Lawrence Mabon, Hastings East Sussex (GB)

(73) Assignee: Aspen Pumps Limited, Hailsham Sussex (GB)

( * ) Notice: Subject to any disclaimer, the term of this patent is extended or adjusted under 35 U.S.C. 154(b) by 93 days.

(21) Appl. No.: 16/340,605

(22) PCT Filed: Oct. 10, 2017

(86) PCT No.: PCT/GB2017/053059

§ 371 (c)(1),
(2) Date: Apr. 9, 2019

(87) PCT Pub. No.: WO2018/069691

PCT Pub. Date: Apr. 19, 2018

(65) Prior Publication Data

US 2019/0271318 A1 Sep. 5, 2019

(30) Foreign Application Priority Data

Oct. 10, 2016 (GB) ..... 1617186.0

(51) Int. Cl.
*F24F 13/22* (2006.01)
*F04D 9/00* (2006.01)
(Continued)

(52) U.S. Cl.
CPC ..... *F24F 13/222* (2013.01); *F04D 9/001* (2013.01); *F04D 9/007* (2013.01); *F04D 9/008* (2013.01);
(Continued)

(58) Field of Classification Search
CPC ..... F24F 13/222; F04D 9/008; F04D 9/001; F04D 9/007
See application file for complete search history.

(56) References Cited

U.S. PATENT DOCUMENTS 2,127,865 A * 8/1938 Goddard ..... F04D 29/2266 277/424
2,470,563 A * 5/1949 Jennings ..... F04D 29/106 417/423.3
(Continued)

FOREIGN PATENT DOCUMENTS

CN 201650881 U 11/2010
CN 202017647 U 10/2011
(Continued)

OTHER PUBLICATIONS

International Search Report for Application No. PCT/GB2017/053059 dated Feb. 13, 2018, 3 pages.
(Continued)

*Primary Examiner* — Moshe Wilensky
*Assistant Examiner* — Brian Christopher Delrue
(74) *Attorney, Agent, or Firm* — Seyfarth Shaw LLP

(57) ABSTRACT

There is provided a centrifugal pump comprising a pumping chamber (106). The pumping chamber (106) has an inner surface (108) defining a pump cavity (110); a pump inlet (112) defined in a first side of the pumping chamber (106); a shaft opening (116) defined substantially centrally in a second side of the pumping chamber (106), the second side substantially opposing the first side and arranged to be above the first side, in use; and a pump outlet (114). The centrifugal pump further comprises an impeller (120) retained within the pump cavity (110); and a shaft member (140) mechanically connected to the impeller (120) through the shaft opening (116), whereby rotation of the shaft member (140) causes rotation of the impeller (120) about a shaft axis (157) passing through the shaft opening (116) and movement of a pumping liquid from the pump inlet (112) towards the pump outlet (114). The centrifugal pump further comprises a flow
(Continued)

modifier (150) provided adjacent to an outer surface (107) of the pumping chamber (106) at the shaft opening (116) to substantially prevent ingress of air into the pump cavity (110) through the shaft opening (116) during operation of the pump even when a water level in a liquid tank (104) surrounding the pumping chamber (106) drops below a level of the shaft opening (116). The flow modifier (150) comprises an annular portion (152) having defined therein a further shaft opening (156) spaced from the shaft opening (116) and having the shaft member (140) passing therethrough. The centrifugal pump comprises a spacing member (154) spacing the annular portion (152) from the outer surface (107). The flow modifier (150) defines a liquid overflow outlet (164) for liquid flow from the shaft opening (116) in a direction substantially transverse to the shaft axis (157). In one example, the liquid overflow outlet (164) is sized to substantially prevent the ingress of air into the pump cavity (110) through the shaft opening (116) during operation of the pump, even when the water level in the liquid tank (104) surrounding the pumping chamber (106) drops below the level of the shaft opening (116). In the same or an alternative example, the annular portion (152) comprises a first portion (158) having defined therein the further shaft opening (156) and a second portion (160) extending towards the outer surface (107) from the first portion (158) and defining the liquid overflow outlet (164). Also in the same or the alternative example, the annular portion (152) defines a stabiliser cavity (166) extending between the shaft opening (116) and the further shaft opening (156) and configured to remain filled with liquid during operation of the pump, even when the water level in the liquid tank (104) surrounding the pumping chamber (106) drops below the level of the shaft opening (116).

21 Claims, 2 Drawing Sheets

(51) Int. Cl.
*F04D 29/42* (2006.01)
*F04D 15/02* (2006.01)

(52) U.S. Cl.
CPC ..... *F04D 15/0218* (2013.01); *F04D 29/426* (2013.01)

(56) References Cited

U.S. PATENT DOCUMENTS 2,581,504 A * 1/1952 Wilfley ..... F04D 29/146 415/109
2,810,349 A * 10/1957 Zozulin ..... F04D 13/025 417/420
2,865,618 A * 12/1958 Abell ..... A01K 63/042 261/93
2,934,245 A * 4/1960 Emeny ..... F04D 29/606 222/330
3,056,911 A * 10/1962 Hart ..... B60S 1/50 318/272
3,160,106 A * 12/1964 Ashworth ..... F04D 7/04 415/112
3,227,087 A * 1/1966 Albee ..... F04D 7/02 415/214.1
3,316,845 A * 5/1967 Schumann ..... F04D 15/0218 417/40
3,677,659 A * 7/1972 Williams ..... F04D 29/049 415/111
3,758,236 A * 9/1973 Zimmerman ..... F04D 29/606 417/360
3,975,118 A 8/1976 Anderson
D268,112 S * 3/1983 Sugiura ..... D15/7
D354,754 S * 1/1995 Broughton ..... D15/7
6,322,326 B1 * 11/2001 Davis ..... F04D 13/08 417/279
6,341,944 B1 * 1/2002 Butcher ..... F04D 15/0218 417/40
6,402,461 B1 6/2002 Tebby
6,817,194 B1 * 11/2004 Leach ..... F24F 13/222 62/150
D508,921 S * 8/2005 Hsieh ..... D15/7
7,252,482 B2 * 8/2007 Walker ..... F04D 13/06 310/63
7,972,117 B1 * 7/2011 MacDonald ..... F04B 49/025 417/40
8,151,592 B2 * 4/2012 Badia ..... H01H 35/18 62/285
8,167,562 B2 * 5/2012 Sakai ..... F04D 29/662 416/178
8,182,243 B2 * 5/2012 Ward ..... F04B 17/04 417/363
8,550,066 B2 * 10/2013 Post ..... F24H 9/0073 126/110 R
8,602,744 B2 * 12/2013 Ward ..... F04D 15/0218 417/36
8,651,824 B2 * 2/2014 Ward ..... F04B 49/04 417/36
8,844,773 B2 * 9/2014 Noordanus ..... F04D 29/606 222/333
9,017,011 B2 * 4/2015 Gatley, Jr. ..... F04D 25/0653 415/98
9,334,876 B2 * 5/2016 Dickinson ..... F04D 29/4266
10,377,097 B2 * 8/2019 Canatella ..... A61M 1/3666
10,415,228 B2 * 9/2019 Irving ..... E03F 1/008
10,704,562 B2 * 7/2020 Cool ..... F04D 29/4226
10,746,190 B2 * 8/2020 Chen ..... F04D 25/062
2006/0182627 A1 * 8/2006 Tibban ..... F04D 9/007 415/206
2008/0025852 A1 * 1/2008 Davis ..... F03B 13/187 417/331
2009/0297373 A1 * 12/2009 Xingcan ..... F04D 25/082 417/423.8
2011/0217188 A1 * 9/2011 Lyons ..... F04B 17/00 417/321
2012/0112586 A1 * 5/2012 Hsiao ..... H02K 5/20 310/89
2012/0114474 A1 * 5/2012 Elsner ..... F04D 29/582 415/203
2013/0183137 A1 * 7/2013 Murray ..... F04D 1/063 415/1
2015/0016958 A1 * 1/2015 Hofmann ..... F04D 29/056 415/55.5
2015/0071773 A1 * 3/2015 Takahashi ..... F04D 29/4293 415/204
2015/0118037 A1 * 4/2015 Otsuka ..... F04D 29/281 415/206
2015/0275919 A1 * 10/2015 Hsiao ..... F04D 13/06 415/115
2016/0245117 A1 * 8/2016 Parnin ..... F01M 1/10
2016/0290312 A1 * 10/2016 Calderone ..... F03B 11/02
2016/0327012 A1 * 11/2016 Beaulieu ..... F03B 11/002
2016/0327046 A1 * 11/2016 Daugaard ..... F04D 29/181
2016/0355069 A1 * 12/2016 Vincent ..... F04D 25/06
2017/0009779 A1 * 1/2017 Niu ..... F04D 1/00
2017/0363103 A1 * 12/2017 Canatella ..... B29D 15/00
2019/0249747 A1 * 8/2019 Wesling ..... F16F 15/322
2019/0257281 A1 * 8/2019 Raina ..... F03B 15/04
2019/0271318 A1 * 9/2019 Mabon ..... F04D 1/02
2019/0290081 A1 * 9/2019 Yoshino ..... F04D 29/16
2020/0046523 A1 * 2/2020 Erdmann ..... A61F 2/70

FOREIGN PATENT DOCUMENTS

EP 1041320 A2 * 10/2000 ..... F04D 29/426
EP 1041320 A2 10/2000

(56) References Cited

FOREIGN PATENT DOCUMENTS

| | | | | | |
|---|---|---|---|---|---|
| GB | 268525 | A | | 4/1927 | |
| GB | 902301 | A | * | 8/1962 | ..... B04B 1/00 |
| GB | 1486277 | A | * | 9/1977 | ..... F04D 9/008 |

OTHER PUBLICATIONS

Written Opinion for Application No. PCT/GB2017/053059 dated Feb. 13, 2018, 7 pages.
Combined Search and Examination Report for Application No. GB1617186.0 dated Feb. 21, 2017, 8 pages.

* cited by examiner

CENTRIFUGAL PUMP FLOW MODIFIER

CROSS REFERENCE TO RELATED APPLICATIONS

This is a National Stage application of, and claims priority to, PCT/GB2017/053059, filed Oct. 10, 2017, which claims priority to GB Patent Application No. 1617186.0, filed Oct. 10, 2016, the disclosures of which are incorporated herein by reference in their entirety.

This invention relates to a flow modifier for use with a centrifugal pump, in particular for use with a centrifugal pump for use in an air conditioning equipment condensate pump.

BACKGROUND

Centrifugal pumps for pumping liquid in air conditioning equipment condensate pump systems are used at least intermittently throughout the duration of operation of the air conditioning equipment to pump liquid condensate away from the air conditioning equipment. Centrifugal pumps operate by rotation of an impeller within the fluid to create a pressure differential across a fluid, whereby to move the fluid from a pump inlet to a pump outlet. The present disclosure provides at least an alternative to centrifugal pumps of the prior art.

BRIEF SUMMARY OF THE DISCLOSURE

In accordance with the present disclosure, there is provided a centrifugal pump comprising a pumping chamber. The pumping chamber has an inner surface defining a pump cavity; a pump inlet defined in a first side of the pumping chamber; a shaft opening defined substantially centrally in a second side of the pumping chamber, the second side substantially opposing the first side and arranged to be above the first side, in use; and a pump outlet. The centrifugal pump further comprises an impeller retained within the pump cavity; and a shaft member mechanically connected to the impeller through the shaft opening, whereby rotation of the shaft member causes rotation of the impeller about a shaft axis passing through the shaft opening and movement of a pumping liquid from the pump inlet towards the pump outlet. The centrifugal pump further comprises a flow modifier provided adjacent to an outer surface of the pumping chamber at the shaft opening to substantially prevent ingress of air into the pump cavity through the shaft opening during operation of the pump even when a water level in a liquid tank surrounding the pumping chamber drops below a level of the shaft opening. The flow modifier comprises an annular portion having defined therein a further shaft opening spaced from the shaft opening and having the shaft member passing therethrough. The centrifugal pump comprises a spacing member spacing the annular portion from the outer surface. The flow modifier defines a liquid overflow outlet for liquid flow from the shaft opening in a direction substantially transverse to the shaft axis. In one example, the liquid overflow outlet is sized to substantially prevent the ingress of air into the pump cavity through the shaft opening during operation of the pump, even when the water level in the liquid tank surrounding the pumping chamber drops below the level of the shaft opening. In the same or an alternative example, the annular portion comprises a first portion having defined therein the further shaft opening and a second portion extending towards the outer surface from the first portion and defining the liquid overflow outlet. Also in the same or the alternative example, the annular portion defines a stabiliser cavity extending between the shaft opening and the further shaft opening and configured to remain filled with liquid during operation of the pump, even when the water level in the liquid tank surrounding the pumping chamber drops below the level of the shaft opening.

The disclosed centrifugal pump prevents the ingress of air into the pump cavity through the shaft opening during operation of the pump, even when the water level in the liquid tank surrounding the pumping chamber drops below the level of the shaft opening. It is hypothesised that this benefit is achieved through selection of an appropriate size for the liquid overflow outlet such that air cannot pass upstream through the liquid overflow outlet, and synergistically or alternatively through the use of the stabiliser cavity to increase the pressure on the flow through the liquid overflow outlet. The increase in pressure makes it substantially impossible for air to pass upstream through the liquid overflow outlet, because substantially the whole liquid overflow outlet is filled by water. It will be understood that the flow modifier alters at least one of a pressure and speed of the liquid flow out of the shaft opening whereby to prevent the ingress of air into the pump cavity through the shaft opening.

In some examples, the spacing member may extend from the annular portion to the outer surface of the pumping chamber at the second side of the pumping chamber. Thus, the annular portion is spaced from the outer surface of the pumping chamber by the spacing member therebetween.

The spacing member may be a plurality of spacing members. In examples, the plurality of spacing members is at least 3 spacing members. The plurality of spacing members may be at least 5 spacing members.

The centrifugal pump may define a plurality of liquid overflow outlets defined between adjacent spacing members. The centrifugal pump may define at least 5 liquid overflow outlets.

The centrifugal pump may comprise a plurality of vanes on the outer surface of the pumping chamber, each extending radially outwards at the shaft opening in a direction transverse to the shaft axis. Thus, the liquid flow out of the shaft opening may slow down as the liquid moves radially outwards between the vanes. The plurality of vanes may extend from the annular portion. The vanes may extend radially inwards of a boundary of the shaft opening. In embodiments, the vanes may be the spacing members.

The annular portion may comprise a brim portion spaced from the outer surface of the pumping chamber and extending radially outwards relative to the shaft axis and extending substantially parallel to the outer surface of the pumping chamber at the second side of the pumping chamber. The vanes may extend radially outwards to a radial boundary of the brim portion.

The flow modifier may only partially define the liquid overflow outlet. The liquid overflow outlet may be defined partially by the outer surface of the pumping chamber at the second side of the pumping chamber.

A narrowest extent of the liquid overflow outlet may be less than 5 millimetres. Thus, at the pumping pressures of pumps for removing condensate from air conditioning systems, the liquid overflow outlet is sized to substantially prevent ingress of air into the pump cavity.

The narrowest extent of the liquid overflow outlet may be in a direction substantially parallel to the shaft axis.

The narrowest extent of the liquid overflow outlet may be in a direction substantially circumferential to the shaft axis.

The flow modifier may be a separate component to the pumping chamber. Thus, the flow modifier may be arranged to be positioned adjacent to the pumping chamber during assembly.

The flow modifier may be fixedly mounted relative to the pumping chamber. Thus, the flow modifier does not rotate with the shaft member.

A clearance between the further shaft opening and the shaft member may be less than a clearance between the shaft opening and the shaft member. Thus, liquid flow is easier through the shaft opening than through the further shaft opening. In examples, the further shaft opening is sized to substantially prevent liquid flow therethrough.

The liquid may typically be water.

A spacing between the shaft opening and the further shaft opening may be greater than 5 millimetres. In some examples, the spacing between the shaft opening and the further shaft opening may be greater than 8 millimetres. Thus, the stabiliser cavity is sized to be filled with sufficient liquid to increase the pressure of the liquid at the liquid overflow outlet, whereby to substantially prevent ingress of air into the pump cavity through the shaft opening.

A total cross-sectional area of the or all of the liquid overflow outlet(s) may be at least 3 times a cross-sectional area of the space between the shaft opening and the shaft member. The total cross-sectional area of the or all of the liquid overflow outlet(s) may be across the or all of the liquid overflow outlet(s). Thus, the liquid overflow outlet(s) also act to slow down a liquid flow out of the flow modifier.

The shaft axis may be arranged to be substantially vertical, in use.

The centrifugal pump may be for use in a tank pump for air conditioning equipment.

The disclosure extends to a tank pump comprising a liquid tank for receiving a volume of liquid to be pumped, the liquid tank surrounding the pumping chamber of the centrifugal pump. The centrifugal pump is as described hereinbefore.

The disclosure extends to a flow modifier for use in a tank pump. The flow modifier comprises an annular portion defining a first shaft opening at a first end of the flow modifier. The first shaft opening defines a shaft axis through the flow modifier. The flow modifier further comprises a spacing member extending from the annular portion towards a second end of the flow modifier and arranged to space the annular portion from an outer surface of a pumping chamber of a centrifugal pump, in use. The flow modifier is configured to be locatable, in use, over a shaft opening provided on an upper side of the outer surface of the pumping chamber, such that the shaft axis passes through the shaft opening of the centrifugal pump. The flow modifier at least partially defines a liquid overflow outlet for liquid flow entering the flow modifier at the second end of the flow modifier, the liquid overflow outlet being arranged to direct liquid flow in a direction substantially transverse to the shaft axis. In one example, the liquid overflow outlet is sized to substantially prevent the ingress of air through the shaft opening of the centrifugal pump when liquid flow enters the flow modifier at the second end of the flow modifier, even when air surrounds an outer region of the flow modifier outside the liquid overflow outlet. In the same or an alternative example, the annular portion comprises a first portion having defined therein the first shaft opening and a second portion extending towards the second end from the first portion and defining the liquid overflow outlet. In the same or the alternative example, the annular portion defines a stabiliser cavity extending from the first shaft opening towards the shaft opening of the centrifugal pump, in use, and configured to remain filled with liquid when liquid flow enters the flow modifier at the second end of the flow modifier, even when air surrounds an outer region of the flow modifier outside the liquid overflow outlet.

BRIEF DESCRIPTION OF THE DRAWINGS

Embodiments of the invention are further described hereinafter with reference to the accompanying drawings, in which.

DETAILED DESCRIPTION

Figure 1:
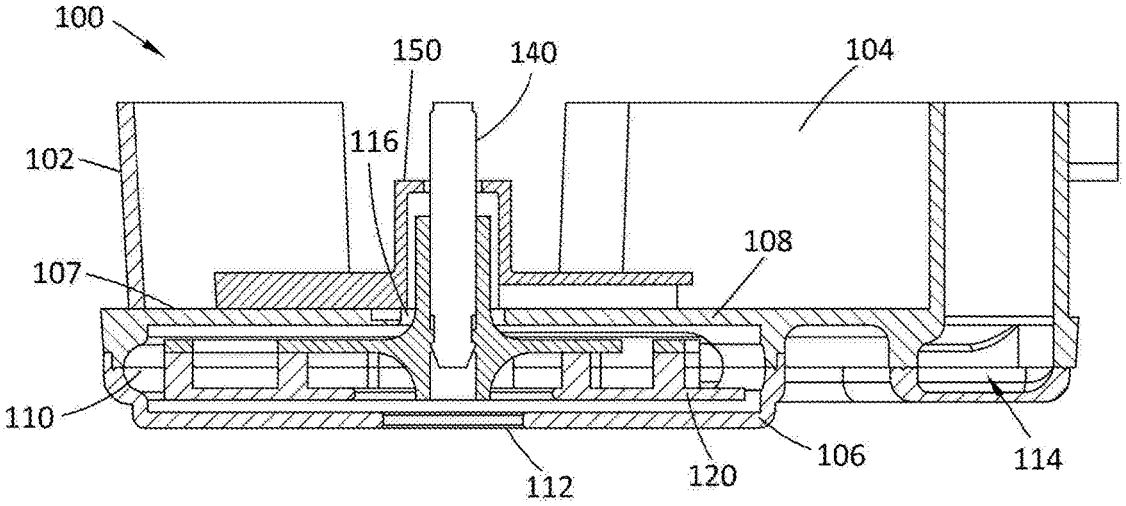
FIG. 1 is an illustration of a section through an air conditioning equipment condensate pump as disclosed herein.

FIG. 1 is an illustration of a section through an air conditioning equipment condensate pump 100 as disclosed herein. It will be understood that an air conditioning equipment condensate pump may also be referred to as an air conditioning equipment tank pump. The air conditioning equipment condensate pump 100 comprises a housing 102. The housing 102 defines a liquid tank 104 for receiving and containing condensate to be pumped out of the air conditioning equipment condensate pump 100. The housing 102 comprises a pumping chamber 106. The pumping chamber 106 has an outer surface 107 and an inner surface 108. The inner surface 108 defines a pump cavity 110 in fluid communication with the liquid tank 104 via a pump inlet 112. The pump inlet 112 is defined in a lower side of the pumping chamber 106. The pumping chamber 106 is part of a centrifugal pump. In this example, the liquid tank 104 and the pump cavity 110 are part of the same chamber, but this is not essential. It will be understood that the illustration of FIG. 1 does not show the liquid tank 104 extending below the lower side of the pumping chamber 106 for clarity of the features of the pumping chamber 106. The liquid tank 104 substantially surrounds the pumping chamber 106 defining the pump cavity 110. Liquid can be expelled from the pump cavity 110 through a pump outlet 114. Typically, the pumping chamber 106 is provided at a lower end of the liquid tank 104. Thus, during filling of the air conditioning equipment condensate pump 100 with liquid (e.g. water), the pump cavity 110 may be substantially completely filled with liquid during an initial filling process of the liquid tank 104 and the air conditioning equipment condensate pump 100 can operate to remove any further liquid from the liquid tank 104.

The pumping chamber 106 contains therein at least an impeller 120 retained within the pump cavity 110. The impeller 120 defines an axial direction, about which the impeller 120 is arranged to rotate to pump fluid through the pump cavity 110. A shaft member 140 is fixedly connected to the impeller 120. The shaft member 140 extends out of the pumping chamber 106 through a shaft opening 116 defined in an upper side thereof. The shaft member 140 is mechanically connected to a motor (not shown). In this way, operation of the motor will cause rotation of the impeller 120. In this example, a distance between the shaft member 140 and the pumping chamber 106 defining the shaft opening 116 is approximately 1 millimetre. Generally, the distance must be minimised to restrict flow of liquid out of the pump cavity 110 through the shaft opening 116, but must be big enough that the shaft member 140 will not contact the sides of the shaft opening 116 and reduce an efficiency of the pump. The impeller 120 further defines a radial direction substantially transverse to the axial direction. It will be understood that many different impellers may be used but that the impeller is arranged to, upon rotation about the axial direction, pump liquid from the pump inlet 108 radially outwards to the pump outlet 110. An impeller that is particularly suitable for use in the present air conditioning equipment condensate pump 100 is described in our application entitled 'Pump Impeller' and filed at the UK Intellectual Property Office on the same day under our reference P232989GB.

The air conditioning equipment condensate pump 100 further comprises a flow modifier 150. The flow modifier 150 is provided adjacent to the outer surface 107 of the pumping chamber 106 and provided at the upper side of the pumping chamber 106 at the shaft opening 116. The flow modifier 150 is rotationally stationary relative to the pumping chamber 106. In this example, the flow modifier 150 is fixedly mounted to the outer surface 107 of the pumping chamber 106. In other examples, it will be understood that the flow modifier 150 may be fixedly mounted to other components of the air conditioning equipment condensate pump 100 such that the flow modifier 150 is fixedly mounted relative to the pumping chamber 106. The flow modifier 150 is arranged to interact with any liquid flow from the pump cavity 110 to the liquid tank 104 through the shaft opening 116 in order to prevent in the ingress of air into the pump cavity 110 through the shaft opening 116 during operation of the air conditioning equipment condensate pump 100. The shape, configuration and operation of the flow modifier 150 will be described in more detail with reference to FIGS. 2 and 3 below.

During operation of the air conditioning equipment condensate pump 100, a pressure gradient exists across the liquid within the pumping chamber 106. A liquid pressure at the pump outlet 114 will be higher than a liquid pressure at the pump inlet 112. The pressure at the pump inlet 112 will be at or just below a hydrostatic pressure due to a fill level of the liquid tank 104. For smooth rotation of the impeller 120 within the pump cavity 110, a small gap is left between the impeller 120 and the pump cavity 110 and also between the impeller 120 and the shaft opening 116. At the upper side of the pumping chamber 106, a small amount of relatively high pressure liquid from a radially outermost portion of the impeller 120 is able to flow radially inwards along an upper channel defined between the impeller 120 and the inner surface 108 of the pumping chamber 106. The relatively high pressure liquid can exit the pump cavity 110 through the shaft opening 116. When the fill level of the liquid tank 104 is near the level of the shaft opening 116, it has been observed that air above the liquid in the liquid tank 104 may enter into the pump cavity 110. It is theorised that the high pressure liquid flow out of the shaft opening 116 can cause turbulent mixing with the liquid and air in the liquid tank 104 around the shaft opening 116 and that this can result in ingress of air into the pump cavity 110. It has been further theorised that the ingress of air into the pump cavity 110 may instead or additionally be due at least in part to pressure variations of the liquid at the shaft opening 116. It is theorised that the pressure variations may be due to the non-continuous pumping of the centrifugal pump which results in the pressure at the pump outlet 114 being pulsed due to the one-at-a-time passage of liquid from a discrete number of impeller cavities in the impeller 120. This results in brief periods of flow-reversal at the shaft opening 116, whereby air may be sucked into the pump cavity 110.

Disadvantageously, air within the pump cavity increases the operational volume of the air conditioning equipment condensate pump 100, as well as negatively impacting pumping efficiency. For this reason, it is known to cease operation of a tank pump before the fill level in the liquid tank drops too close to the shaft opening 116. This reduces the proportion of liquid within the liquid tank that can be expelled by the tank pump during each operation cycle of the tank pump. This can also reduce the operating lifetime of a tank pump because the pump may need to be switched on and off more times to pump out the same volume of liquid.

Furthermore, the high pressure liquid flow out of the shaft opening 116 can cause a jet of liquid to impact an outer wall of the housing 102 when the liquid level is near the level of the shaft opening 116 causing further noise generation.

The use of the flow modifier 150 negates these downsides by preventing the ingress of air into the pump cavity 110. Therefore, the pump can be run even when the fill level of the liquid tank 104 drops below the level of the shaft opening 116 and until the fill level of the liquid tank 104 reaches almost to the level of the pump inlet 112.

In this example, the housing 102, the pumping chamber 106, the impeller 120 and the flow modifier 150 are formed from a plastics material. It will be appreciated that in other examples, one or more of the housing 102, the pumping chamber 106, the impeller 120 and the flow modifier 150 could be formed from other materials such as metal or composite materials and could be formed by moulding, casting, 3D printing, pressing or any other suitable manufacturing method.

Figure 2:
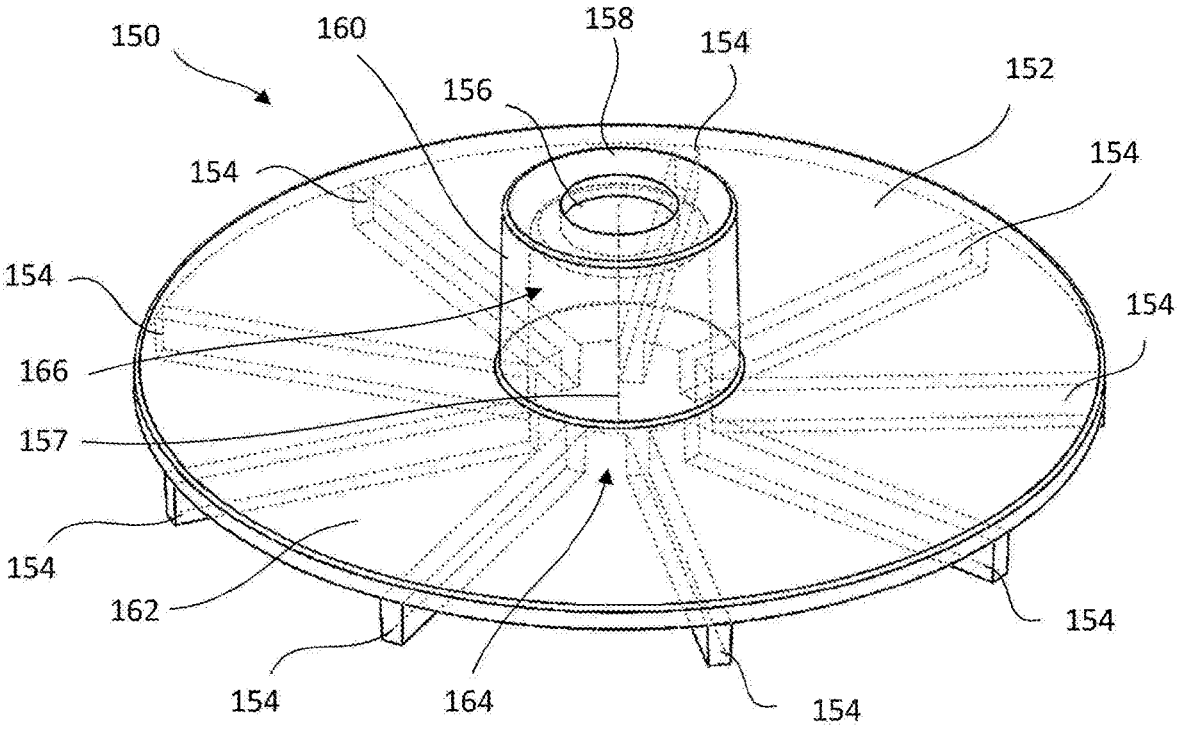
FIG. 2 is an illustration of the flow modifier for the centrifugal pump shown in the air conditioning equipment condensate pump shown in FIG. 1.
Figure 3:
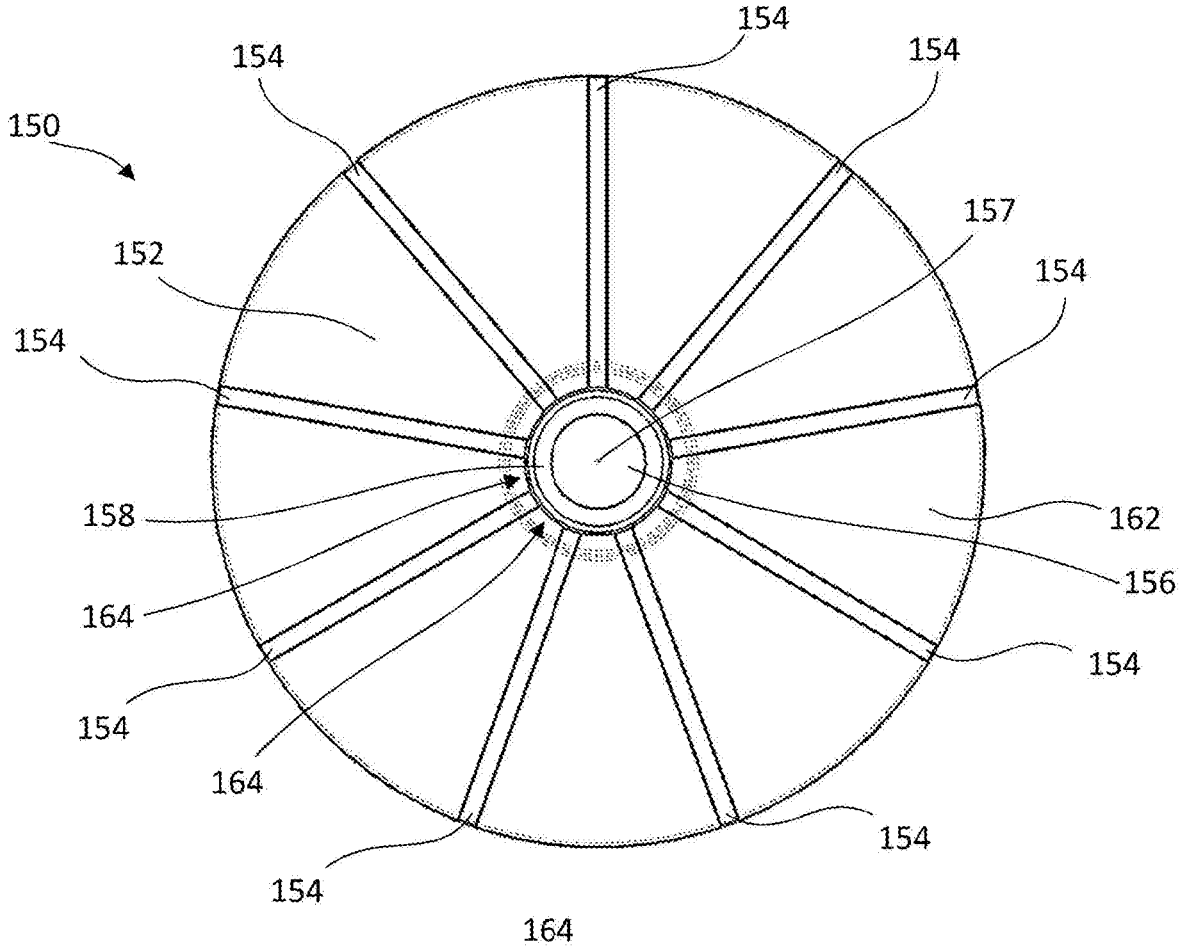
FIG. 3 is a further view of the flow modifier shown in FIG. 2.

FIG. 2 is an illustration of the flow modifier for the centrifugal pump shown in the air conditioning equipment condensate pump shown in FIG. 1. FIG. 3 is a further view of the flow modifier shown in FIG. 2. In this example, the flow modifier 150 comprises an annular portion 152 and a spacing member in the form of nine vanes 154. In other examples, the spacing member may take other forms, for example spacing pins or fixing struts to space the annular portion 152 of the flow modifier 150 from the outer surface 107 of the pumping chamber 106 at the shaft opening 116 by fixing the flow modifier 150 to the air conditioning equipment condensate pump 100. The spacing member is provided at a distal end of the annular portion 152. A further shaft opening 156 is defined in the annular portion 152, and in particular defined in a first portion 158 of the annular portion 152 at a proximal end of the annular portion 152. In use, the shaft member 140 (see FIG. 1) extends through the further shaft opening 156. The further shaft opening 156 defines an axial direction 157 through the flow modifier 150. A spacing between the shaft member 140 and the first portion 158 defining the further shaft opening 156 is less than a spacing between the impeller 120 and the shaft opening 116 (see FIG. 1) and is approximately 0.5 millimetres. The annular portion 152 further comprises a second portion 160 extending from the first portion 158 towards the vanes 154. The first portion 158 and the second portion 160 together define a stabiliser cavity 166 which surrounds the shaft member 140 (see FIG. 1), in use. The stabiliser cavity 166 is arranged to fill with liquid as a fill level of the air conditioning equipment condensate pump 100 rises up to and above a level of the further shaft opening 156. The stabiliser cavity 166 is further arranged to remain filled with liquid during operation of the air conditioning equipment condensate pump 100, even when the water level drops below the level of the further shaft opening 156 or below the level of the shaft opening 116. In this example, the second portion 160 is substantially cylindrical. It will be understood that the second portion 160 may take a number of other shapes providing a stabiliser cavity therein. A diameter of the stabiliser cavity 166 is approximately 8 millimetres. The annular portion 152 also comprises a brim portion 162 extending radially outwards from the second portion 160. The vanes 154 extend from a distalmost surface of the brim portion 162 to space the brim portion 162 from the outer surface 107 of the pumping chamber 106, in use. The vanes 154 also extend radially to a radially outermost extent of the brim portion 162. In this example, the flow modifier 150 defines nine liquid overflow outlets 164, in particular defined by facing surfaces of adjacent vanes 154 near a root of the adjacent vanes 154 and the distalmost surface of the brim portion 162. It will be understood that other examples may have more or fewer liquid overflow outlets 164. In use, the liquid overflow outlets 164 are also defined by the outer surface 107 of the pumping chamber 106 (see FIG. 1). A spacing between a distalmost surface of the first portion 158 defining the stabiliser cavity 166 and the proximal-most extent of the liquid overflow outlets 164 (in this example, the distalmost surface of the brim portion 162) is approximately 12 millimetres. A height of the liquid overflow outlets 164 when the flow modifier 150 is positioned against the outer surface 107 of the pumping chamber 106 is approximately 3 millimetres. A width of the liquid overflow outlets 164 is approximately 3 millimetres. A diameter of the brim portion 162 is approximately 60 millimetres. A radial extent of the vanes 154 is approximately 25 millimetres. In this example, the flow modifier 150 is moulded from a plastics material. The flow modifier 150 may alternatively be formed using other techniques such as 3D printing or pressing, and may be formed from other materials, themselves requiring alternative manufacturing techniques, such as casting from metal or manufacture from composite materials. FIG. 3 shows the flow modifier 150 viewed from a distalmost end of the flow modifier 150.

The flow modifier 150 shown in FIGS. 2 and 3 is only one example of a flow modifier for providing an air conditioning equipment condensate pump capable of operating quietly. In use, it is theorised that the liquid within the stabiliser cavity 166 provides a stabilising effect to the liquid flowing out of the shaft opening 116. It is further theorised that the liquid overflow outlets 164 are sufficiently small that air cannot propagate radially inwards when liquid (in particular water) is flowing out of the flow modifier 150 through the liquid overflow outlets 164.

Although the flow modifier 150 is shown as a separate component to the outer surface 107 of the pumping chamber 106, it will be understood that some or all of the features of the flow modifier 150 could be integrally formed on the outer surface 107 of the pumping chamber 106.

Throughout the description and claims of this specification, the words "comprise" and "contain" and variations of them mean "including but not limited to", and they are not intended to (and do not) exclude other components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The invention claimed is:

1. A centrifugal pump comprising:

a pumping chamber having:

an inner surface defining a pump cavity a pump inlet defined in a first side of the pumping chamber;

a shaft opening defined substantially centrally in a second side of the pumping chamber, the second side opposing the first side and arranged to be above the first side, in use; and a pump outlet;

an impeller retained within the pump cavity; and a shaft member mechanically connected to the impeller through the shaft opening, whereby rotation of the shaft member causes rotation of the impeller about a shaft axis passing through the shaft opening and movement of a pumping liquid from the pump inlet towards the pump outlet, wherein the centrifugal pump further comprises a flow modifier provided adjacent to an outer surface of the pumping chamber at the shaft opening to prevent ingress of air into the pump cavity through the shaft opening during operation of the pump even when a water level in a liquid tank surrounding the pumping chamber drops below a level of the shaft opening, wherein the flow modifier comprises:

an annular portion having defined therein a further shaft opening spaced from the shaft opening and having the shaft member passing therethrough, wherein the centrifugal pump comprises a spacing member spacing the annular portion from the outer surface, and the flow modifier defines a liquid overflow outlet for liquid flow from the shaft opening in a direction substantially transverse to the shaft axis, wherein:

(a) the liquid overflow outlet is sized to prevent the ingress of air into the pump cavity through the shaft opening during operation of the pump, even when the water level in the liquid tank surrounding the pumping chamber drops below the level of the shaft opening; and/or wherein (b) the annular portion comprises a first portion having defined therein the further shaft opening and a second portion extending towards the outer surface from the first portion and defining the liquid overflow outlet, wherein the annular portion defines a stabiliser cavity extending between the shaft opening and the further shaft opening and configured to remain filled with liquid during operation of the pump, even when the water level in the liquid tank surrounding the pumping chamber drops below the level of the shaft opening.

2. A centrifugal pump as claimed in claim 1, wherein the spacing member extends from the annular portion to the outer surface of the pumping chamber at the second side of the pumping chamber.

3. A centrifugal pump as claimed in claim 2, wherein the spacing member is a plurality of spacing members.

4. A centrifugal pump as claimed in claim 3, wherein the centrifugal pump defines a plurality of liquid overflow outlets defined between adjacent spacing members.

5. A centrifugal pump as claimed in claim 4, wherein the centrifugal pump defines at least 5 liquid overflow outlets.

6. A centrifugal pump as claimed in claim 1, wherein the spacing member comprises a plurality of vanes on the outer surface of the pumping chamber, each extending radially outwards at the shaft opening in a direction transverse to the shaft axis.

7. A centrifugal pump as claimed in claim 6, wherein the vanes extend radially inwards of a boundary of the shaft opening.

8. A centrifugal pump as claimed in claim 1, wherein the annular portion comprises a brim portion spaced from the outer surface of the pumping chamber and extending radially outwards relative to the shaft axis and extending parallel to the outer surface of the pumping chamber at the second side of the pumping chamber.

9. A centrifugal pump as claimed in claim 1, wherein the liquid overflow outlet is defined partially by the outer surface of the pumping chamber at the second side of the pumping chamber.

10. A centrifugal pump as claimed in claim 1, wherein a narrowest extent of the liquid overflow outlet is less than 5 millimetres.

11. A centrifugal pump as claimed in claim 10, wherein the narrowest extent of the liquid overflow outlet is in a direction parallel to the shaft axis.

12. A centrifugal pump as claimed in claim 10, wherein the narrowest extent of the liquid overflow outlet is in a direction circumferential to the shaft axis.

13. A centrifugal pump as claimed in claim 1, wherein the flow modifier is a separate component to the pumping chamber.

14. A centrifugal pump as claimed in claim 1, wherein the flow modifier is fixedly mounted relative to the pumping chamber.

15. A centrifugal pump as claimed in claim 1, wherein a clearance between the further shaft opening and the shaft member is less than a clearance between the shaft opening and the shaft member.

16. A centrifugal pump as claimed in claim 1, wherein a spacing between the shaft opening and the further shaft opening is greater than 5 millimetres.

17. A centrifugal pump as claimed in claim 1, wherein a total cross-sectional area of the or all of the liquid overflow outlet(s) is at least 3 times a cross-sectional area of the space between the shaft opening and the shaft member.

18. A centrifugal pump as claimed in claim 1, wherein the shaft axis is arranged to be vertical, in use.

19. A centrifugal pump as claimed in claim 1, for use in a tank pump for air conditioning equipment.

20. A tank pump comprising a liquid tank for receiving a volume of liquid to be pumped, the liquid tank surrounding the pumping chamber of the centrifugal pump as claimed in claim 1.

21. A flow modifier for use in a tank pump, the flow modifier comprising:

an annular portion defining a first shaft opening at a first end of the flow modifier, the first shaft opening defining a shaft axis through the flow modifier; and a spacing member extending from the annular portion towards a second end of the flow modifier and arranged to space the annular portion from an outer surface of a pumping chamber of a centrifugal pump, in use, wherein the flow modifier is configured to be locatable, in use, over a shaft opening provided on an upper side of the outer surface of the pumping chamber, such that the shaft axis passes through the shaft opening of the centrifugal pump, wherein, the flow modifier at least partially defines a liquid overflow outlet for liquid flow entering the flow modifier at the second end of the flow modifier, the liquid overflow outlet being arranged to direct liquid flow in a direction substantially transverse to the shaft axis, wherein:

(a) the liquid overflow outlet is sized to prevent the ingress of air through the shaft opening of the centrifugal pump when liquid flow enters the flow modifier at the second end of the flow modifier, even when air surrounds an outer region of the flow modifier outside the liquid overflow outlet; and/or wherein (b) the annular portion comprises a first portion having defined therein the first shaft opening and a second portion extending towards the second end from the first portion and defining the liquid overflow outlet, wherein the annular portion defines a stabiliser cavity extending from the first shaft opening towards the shaft opening of the centrifugal pump, in use, and configured to remain filled with liquid when liquid flow enters the flow modifier at the second end of the flow modifier, even when air surrounds an outer region of the flow modifier outside the liquid overflow outlet.

* * * * *